US005709569A

United States Patent [19]

Buck et al.

[11] Patent Number: 5,709,569

[45] Date of Patent: Jan. 20, 1998

[54] PANEL MOUNT BRACKET FOR ELECTRICAL CONNECTOR

[75] Inventors: Jonathan Earl Buck, Santa Clara; Brian Patrick Costello, Redwood City, both of Calif.

[73] Assignee: The Whitaker Corporation, Wilmington, Del.

[21] Appl. No.: 742,008

[22] Filed: Oct. 31, 1996

[51] Int. Cl.[6] ..... H01R 13/648

[52] U.S. Cl. ..... 439/607; 439/939

[58] Field of Search ..... 439/607, 609, 439/939, 527, 533, 569, 573

[56] References Cited

U.S. PATENT DOCUMENTS 5,376,011 12/1994 Rudy, Jr. et al. ..... 439/79
5,405,267 4/1995 Koegel et al. ..... 439/79
5,591,050 1/1997 Sueoka ..... 439/607

OTHER PUBLICATIONS

*AMP Drawing No. C-787616*, "Receptacle Assembly, Right Angle, 4 Position, Thru-Hole, USB", one page; (1995); AMP Incorporated, Harrisburg, PA.

US Patent Application Serial No. 08/690,410 filed Jul. 25, 1996 (Abstract and Drawings only included).

*Primary Examiner*—Khiem Nguyen
*Attorney, Agent, or Firm*—Anton P. Ness

[57] ABSTRACT

Bracket (10) adapted to be mounted to a conductive panel (12) for mounting a shielded connector (50) thereto, where the connector is of a design intended for mounting to a circuit board but is instead terminated to a cable (70). First and second support sections (26,30) extend rearwardly from panel mounting section (16); connector (50) is placed therebetween, and solder joints are defined between the bracket and the connector's shield (64).

5 Claims, 2 Drawing Sheets

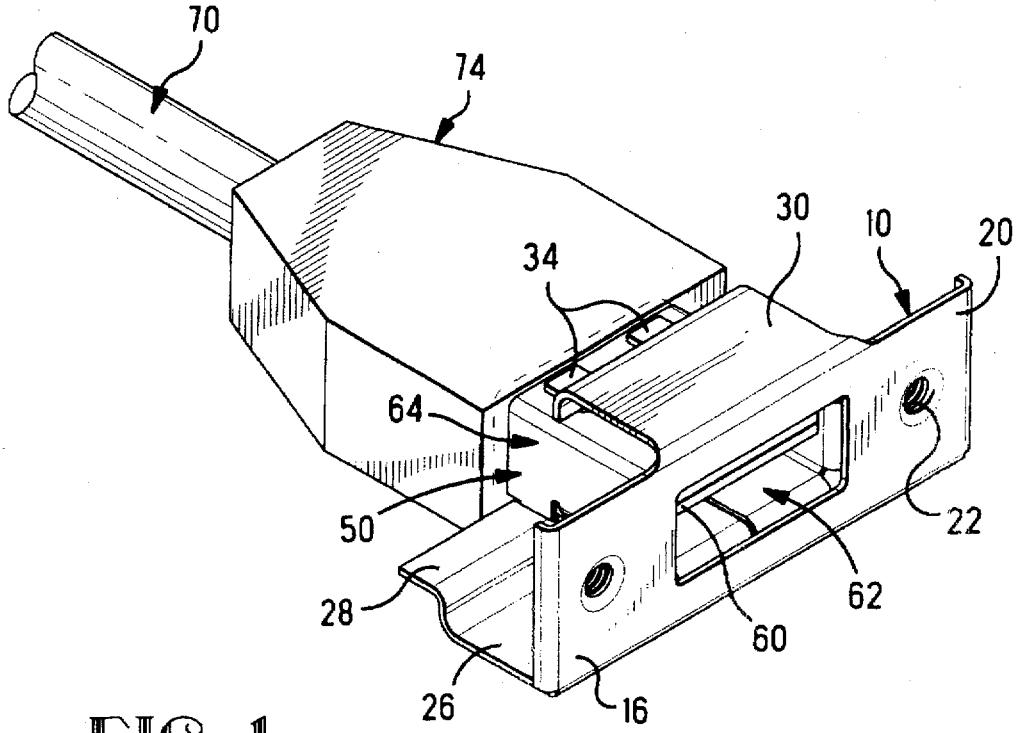
FIG. 1
FIG. 3
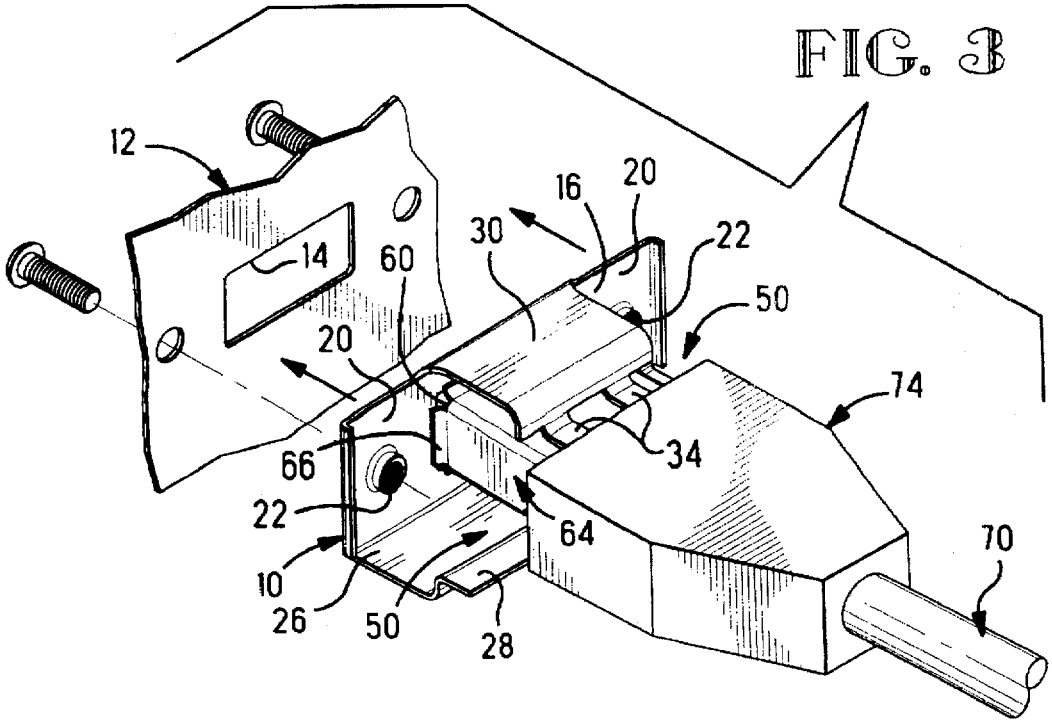

PANEL MOUNT BRACKET FOR ELECTRICAL CONNECTOR

FIELD OF THE INVENTION

This relates to the field of electrical connectors and more particularly to connectors mountable at a panel cutout.

BACKGROUND OF THE INVENTION

In U.S. patent application Ser. No. 08/690,410 filed Jul. 25, 1996 is disclosed an electrical connector mountable within an electronic apparatus such as a computer, at an input/output port thereof, and is mounted onto a circuit board that is fixed within the computer adjacent to a cutout of a conductive panel; the application also discloses a holder for holding two such connectors. A conductive shield of the connector includes a plurality of tabs or flanges extending slightly forwardly of the mating face to surround the periphery of the panel cutout for shielding against electromagnetic/radiofrequency interference (EMI/RFI).

It is desired to provide a mechanism for mounting a connector that is of a design fabricated for mounting to a circuit board, directly to the panel at the cutout after being terminated to a cable.

SUMMARY OF THE INVENTION

The present invention is a bracket affixable to an electrical connector in grounded engagement with the shield thereof, and includes apertures adapted for receipt thereinto of fasteners for fastening the bracket/connector assembly to a panel at a cutout thereof, as well as providing mechanical support to the connector extending from the panel. The bracket includes at least one connector support section extending rearwardly from a panel mounting body along which the connector is placed, after which the connector's shield is electrically connected, such as by soldering, to a portion thereof for an assured ground connection. Preferably, upper and lower support sections coextend rearwardly from top and bottom edges of the body to receive the connector therebetween, and the shield may be soldered to portions of both thereof. Embodiments of the present invention will now be described by way of example with reference to the accompanying drawings.

BRIEF DESCRIPTION OF THE DRAWINGS

FIG. 1 is an isometric view from forwardly thereof of the bracket of the present invention assembled to a connector terminated to a cable;

FIG. 3 is an isometric view of the assembly of FIG. 1 from rearwardly thereof, being mounted to a panel.

DETAILED DESCRIPTION

Figure 4:
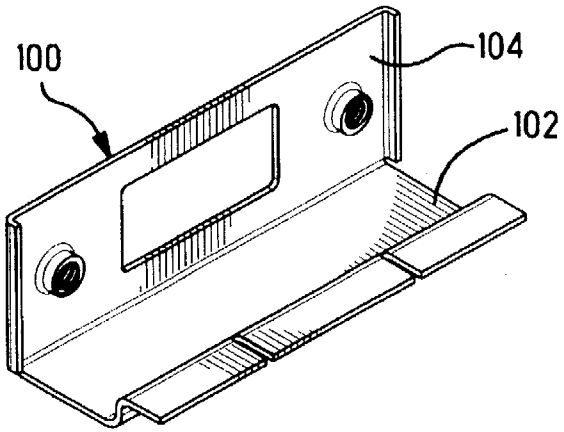
FIG. 4 is an isometric view of a second embodiment of a bracket.

Bracket 10 comprises a stamped and formed conductive member that adapts a shielded connector 50 generally of an existing design for mounting to a circuit board, for being terminated to a cable 70 rather than to a circuit board, thereby requiring mounting of the connector directly to a conductive panel or chassis 12. Connector 50 is of the type having an insulative housing 52 containing a plurality of contacts 54 extending from contact sections 56 at a rear face

58 to a mating face 60 where contact sections (not shown) thereof are exposed within a plug-receiving cavity 62 for mating. Plug-receiving cavity 62 is to be aligned with a cutout 14 of panel 12, and conductive shield 64 around housing 52 is adapted at mating face 60 with flanges 66 to engage the panel 12 around the cutout for EMI/RFI shielding. Generally, connector 50 is similar to the Universal Serial Bus Connector sold by AMP Incorporated, Harrisburg, Pa. as Part No. 787616, that is adapted for mounting to a circuit board (not shown), with contact sections 56 being bent to define right-angles to be inserted into and soldered within through-holes of the board, and with legs 68 of shield 64 insertable through mounting holes of the board and soldered therewithin, thereby establishing a ground connection to a ground circuit of the board.

Bracket 10 includes a panel mounting body 16 having a plug-receiving cutout 18 to be aligned with panel cutout 14, and mounting flanges 20 to either side of cutout 18 having apertures therethrough, preferably threaded apertures 22 tapped into embossments 24 formed thereon, into which fasteners are threadable for securing the bracket to the panel, whereby the bracket becomes groundingly engaged with panel 12. At least one connector support section extends rearwardly from panel mounting body 16 along which the connector is disposed, with the shield of the connector being electrically connected thereto such as by soldering.

Preferably, first connector support section 26 extends rearwardly from a bottom edge of body 16 to a ledge 28, and second support section 30 extends rearwardly from a top edge of body 16 to a rearward edge 32 from which a tab extends, or a pair of tabs 34 coextend. First and second support sections 26,30 define therebetween a connector-receiving region 36 into which is inserted connector 50 for being secured to bracket 10 with plug-receiving cavity 62 aligned with plug-receiving cutouts 18,16 of body 14 and panel 12; first support section 26 abuts the bottom face of housing 52, while second support section 30 is disposed along the top of shield 64.

Optionally, first and second support sections 26,30 slightly converge at rearward edge portions thereof to a dimension therebetween just less than the height of a corresponding portion of the connector to assure engagement by the support sections with connector 50 prior to soldering, facilitating the process by serving to hold the connector in position for soldering; also, a sufficient spring bias may be so created between one of the first and second support sections against the shield that soldering may be unnecessary to obtain a grounding connection therebetween.

To adapt connector 50 for termination to cable 70, contact sections 56 of contacts 54 are maintained straight instead of being bent to define the right angles for through-hole mounting, and are soldered to conductors of cable 70, while the drain wire of the cable is soldered to shield 62 to establish a ground connection. To adapt connector 50 for use with bracket 10, legs 68 of the shield are bent outwardly along surfaces of ledge 28 for electrical connection thereto, such as being soldered to lower surfaces 38 of ledge 28 after being urged forwardly through slots 40 into ledge 28; optionally the legs may be bent prior to assembly, or the legs may even be removed and a butt joint soldered between the shield lower edge portion and the ledge. Tabs 34 are groundingly connected to top surfaces 72 of shield 62 such as by soldering.

Insulative material is then, preferably, molded in a low pressure process around the rearward end of the connector to define an overmolded housing 74 extending a limited distance forwardly along the connector and rearwardly a distance along the cable end, that adheres to the rearward connector end for insulating the solder terminations of the cable conductors to contact sections 56, and the drain wire to the shield 64.

Panel mounting body 16 of bracket 10 preferably is dimensioned larger than is sufficient to surround the mating face of connector 50, such that the bracket is useful with panels having a cutout larger than is necessary for insertion therethrough of a plug complementary to the plug-receiving cavity of connector 50; and apertures 22 preferably are centered vertically between the top and bottom edges of panel mounting body 16.

Figure 2:
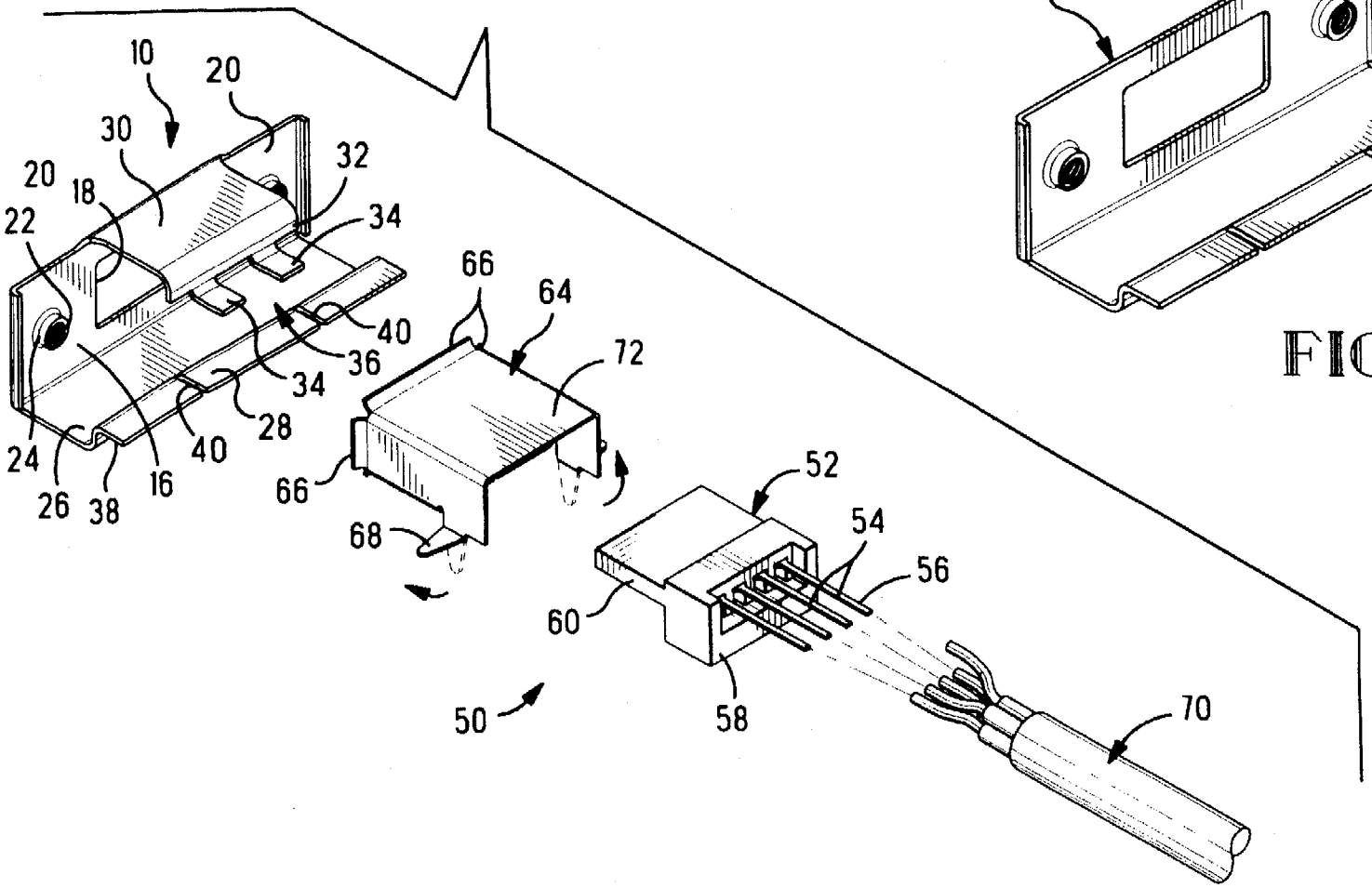
FIG. 2 is an exploded isometric view of the assembly of FIG. 1 from rearwardly thereof and prior to molding of the insulative rear cover.

Bracket 100 shown in FIG. 4 is similar to bracket 10 of FIGS. 1 to 3 but has only a single connector support section 102 extending rearwardly from panel mounting body 104 thereof, such as from the bottom edge thereof, to which the shield of a connector is to be electrically and mechanically connected.

With the bracket of the present invention, only minimal modification is made to the connector of an existing board mountable design while a sturdy attachment is provided to secure the connector to the panel or chassis of the electronic apparatus.

Modifications and variations may be made to the brackets specifically described herein, that are within the spirit of the invention and the scope of the claims.

What is claimed is:

1. A bracket for securing a shielded electrical connector to a panel at an input/output port of an electronic apparatus, comprising:

an integral member having a panel mount body through which extends a cutout for aligning with the input/output port and having flanges on either side of said cutout with fastener-receiving apertures therethrough for aligning with mounting apertures of said panel; and said integral member further having at least a first connector support section extending rearwardly from said panel mounting body along a portion of which is disposed said connector and to a portion of which a shield of said connector is electrically connected, whereby a shielded connector is affixable to said bracket substantially without modification thereto.

2. The bracket as set forth in claim 1 wherein first and second support sections coextend rearwardly from opposed edges of said panel mount body defining a connector-receiving region therebetween; and said first and second support sections having mounting portions coextending closely adjacent to top and bottom surfaces of said connector.

3. The bracket as set forth in claim 2 wherein said first support section defines a ledge along a rearward edge thereof including slots extending forwardly from said rearward edge wherethrough may extend board-mounting legs of said connector shield, whereafter said board-mounting legs may be bent to coextend along lower surfaces of said ledge to be electrically connected thereto.

4. The bracket as set forth in claim 2 wherein said second support section defines at least one tab extending from a rearward edge thereof along a top surface of said connector shield to be electrically connected thereto.

5. The bracket as set forth in claim 2 wherein rearward end portions of said first and second support sections are less distance apart prior to assembly than a height of a corresponding portion of said connector to be inserted into said connector-receiving region.

* * * * *